US006244576B1

(12) United States Patent
Tsai

(10) Patent No.: US 6,244,576 B1
(45) Date of Patent: Jun. 12, 2001

(54) MIST HUMIDIFIER

(76) Inventor: Kuo Lung Tsai, 4Fl. No. 27, Lane 160, Hsin Sheng S. Rd., Sec. 1, Taipei 100 (TW)

( * ) Notice: Subject to any disclaimer, the term of this patent is extended or adjusted under 35 U.S.C. 154(b) by 0 days.

(21) Appl. No.: 09/436,658

(22) Filed: Nov. 9, 1999

(51) Int. Cl.[7] ..... B01F 3/04

(52) U.S. Cl. ..... 261/141; 261/28; 261/72.1; 261/81; 261/DIG. 65

(58) Field of Search ..... 261/28, 29, 30, 261/72.1, 73, 81, 82, 141, 142, DIG. 65

(56) References Cited

U.S. PATENT DOCUMENTS 3,756,577 * 9/1973 Breiling ..... 261/DIG. 65
5,158,716 * 10/1992 Hirokane ..... 261/81
5,611,967 * 3/1997 Jane et al. ..... 261/72.1
5,645,769 * 7/1997 Tamaru et al. ..... 261/81
5,971,369 * 10/1999 Neveu et al. ..... 261/DIG. 65

FOREIGN PATENT DOCUMENTS

0123456 A2 * 1/2000 (EP) ..... 100/100

* cited by examiner

*Primary Examiner*—C. Scott Bushey
(74) *Attorney, Agent, or Firm*—Bacon & Thomas, PLLC

(57) ABSTRACT

A mist humidifier has a lower space receiving a main water tank for storing water and an upper space divided into an evaporative cavity and a blower cavity. The evaporative cavity is divided into a first water chamber for storing water fed from main water tank having a float ball safety valve, a second water chamber for receiving a nebulizer for vaporizing water for creating cool mist, a third water chamber for receiving a heater for heating water for creating a hot mist, and a water supply tube provided on the bottom of the first water chamber in fluid communication with the second and third water chambers so as to keep all water chambers at a constant equal level, whereby a mist having a temperature at a constant level is discharged into the environment when the humidifier is activated.

12 Claims, 6 Drawing Sheets

MIST HUMIDIFIER

BACKGROUND OF THE INVENTION

1. Field of the Invention

The present invention relates to the field of humidifiers and more particularly to a humidifier capable of discharging mist having a temperature at a constant level.

2. Description of Related Art

Conventionally, humidifiers are used to increase humidity in the room in the continental climate areas. A conventional humidifier comprises a nebulizer (or a heater) for converting water into a fine cool (or hot) mist, and a blower for carrying the cool (or hot) mist out of the humidifier into the environment to be humidified wherein a water tank having an orifice on the bottom is vertically provided on a cavity of the lower space below the top of base. The cavity is served for retaining a liquid supplying to a cool (or hot) mist cavity and a valve is provided between the cavity for holding the water tank thereon and the cool (or hot) cavity. The opening or closing of the valve is controlled by the discharged liquid level of the cool (or hot) cavity. As such, the substantial amount of water supplied by the tank is varied up and down, i.e., not at a constant amount so that the temperature of mist discharged from the conventional humidifier can not be kept in constant. Further, mist is generated in the lower part of the space having a considerably height difference with the top adjacent to the inlet of discharging tube. As such, a high power motor is required to pump mist upwardly to reach to the inlet of discharging tube. In view of this, this prior art humidifier is not economical in saving energy and requires a relatively large motor and blower which in turn occupies a significant amount of space. It is known that water tank only occupies one fourth of the humidifier. As a result, a frequent liquid supplying operation is inevitable thus bothering user a lot.

Another drawback of this prior art humidifier is the manual water supplying operation because the only orifice of water tank is provided in the bottom. In other words, there is no top orifice on the water tank so user must periodically take empty water tank out of the cavity for supplying water therein.

Additionally, the cavity is always retaining liquid therein when the humidifier not used, micro-organism may easily grow in the bottom of the cavity thus not hygienic.

Furthermore, a combination of cool and warm mist is not available in most conventional humidifiers because most commonly used high frequency ultrasonic transducers having a nebulizer are not designed to operate in a high temperature environment. In other words, a shortened life is anticipated if it does operate in such condition. One may use a nebulizer capable of operating in high temperature. However, the high cost of buying such nebulizer makes it impractical in fact.

Thus, it is desirable to provide an improved humidifier in order to overcome the above drawbacks of prior art.

SUMMARY OF THE INVENTION

It is an object of the present invention to provide a mist humidifier wherein cool and hot water tanks both have a minimum level of water and water is supplied to cold and hot water tanks in a continuous minimum way as such mist discharged from humidifier having a temperature at a constant level.

It is another object of the present invention to provide a mist humidifier wherein a nebulizer is properly disposed in a position free from affect of the high temperature of heater thus prolonging the life cycle of the nebulizer.

It is a further object of the present invention to provide a mist humidifier further comprising a hose in the discharge outlet for directing mist to a woman's face for beautifying the face.

It is still further object of the present invention to provide a mist humidifier wherein the water tank has an inlet in a suitable position for facilitating the water supplying in an automatic manner for easing operation.

To achieve the above and other objects, the present invention provides a mist humidifier comprising a body for storing liquid; a nebulizer for converting liquid into a fine cool mist, and a blower for drawing ambient air into the body in order to create an air stream to carry mist out of the humidifier wherein the body is divided into a lower space receiving a main water tank for storing liquid and an upper space which further divided into an evaporative cavity and a blower cavity. Evaporative cavity is divided into a first water chamber for storing water fed from main water tank having a float ball safety valve, a second water chamber for receiving nebulizer which functioned as vaporizing water for creating cool mist, a third water chamber for receiving heater which functioned as heating water for creating a hot mist, and a water supply tube provided on the bottom of the first water chamber in fluid communication with the second and third water chambers so as to keep all water chambers at a constant equal level. By utilizing this, a mist having a temperature at a constant level is discharged from humidifier when humidifier is activated.

The above and other objects, features and advantages of the present invention will become apparent from the following detailed description taken with the accompanying drawings.

DETAILED DESCRIPTION OF THE PREFERRED EMBODIMENTS

Figure 1:
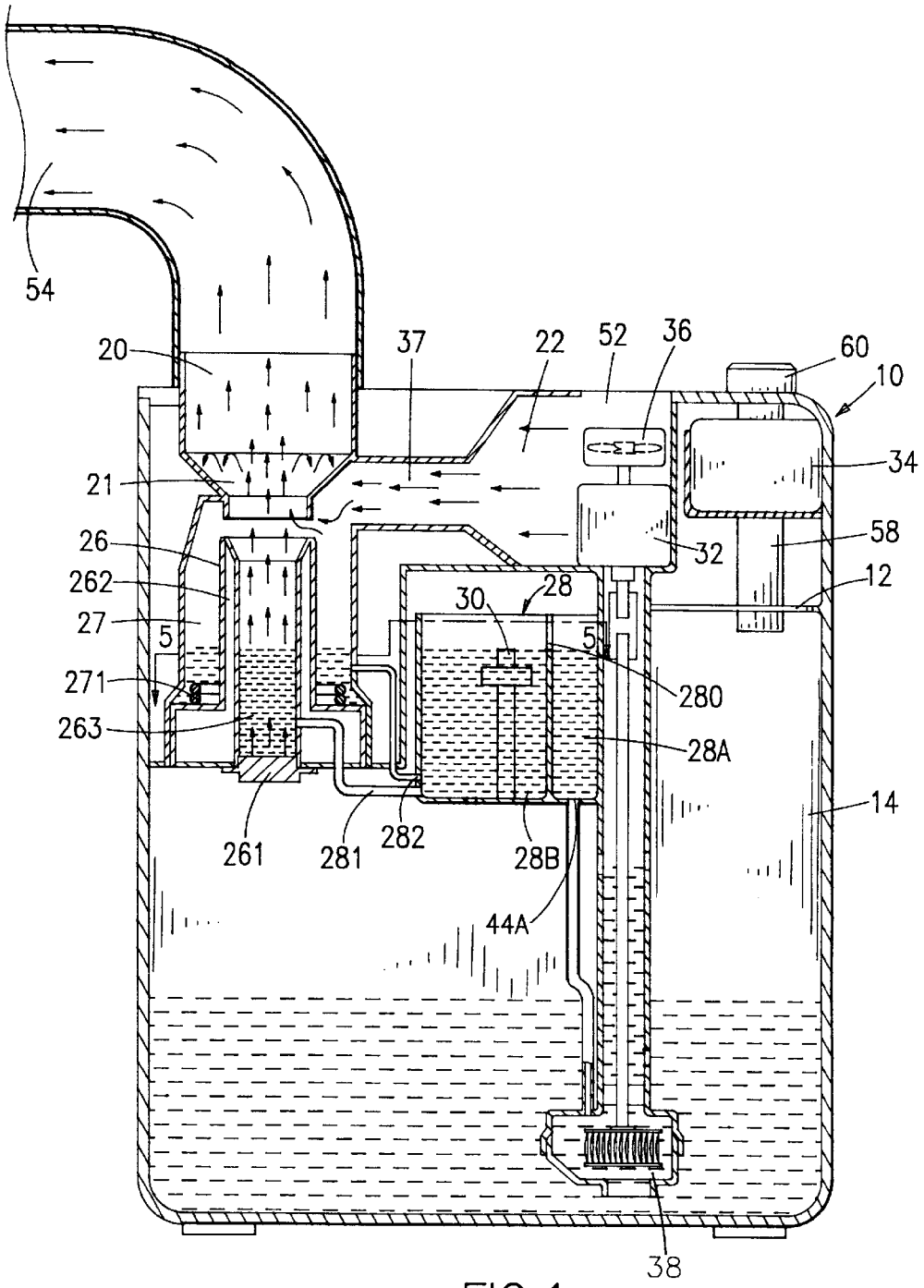
FIG. 1 is a longitudinal sectional view of a first embodiment of a mist humidifier of the present invention illustrating the generation of cool mist.
Figure 2:
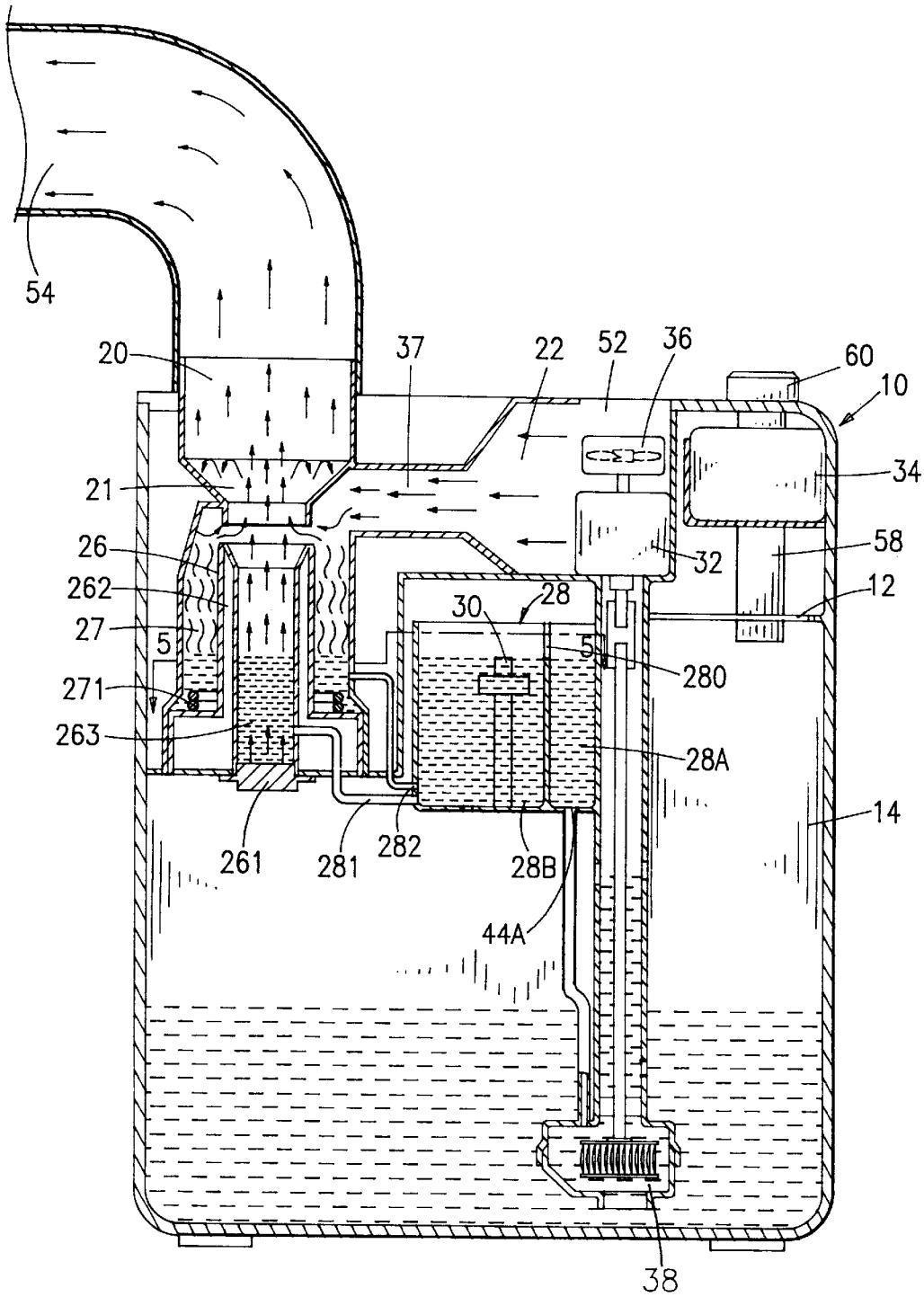
FIG. 2 is same as view of FIG. 1 illustrating the generation of cool mist and warm mist.
Figure 3:
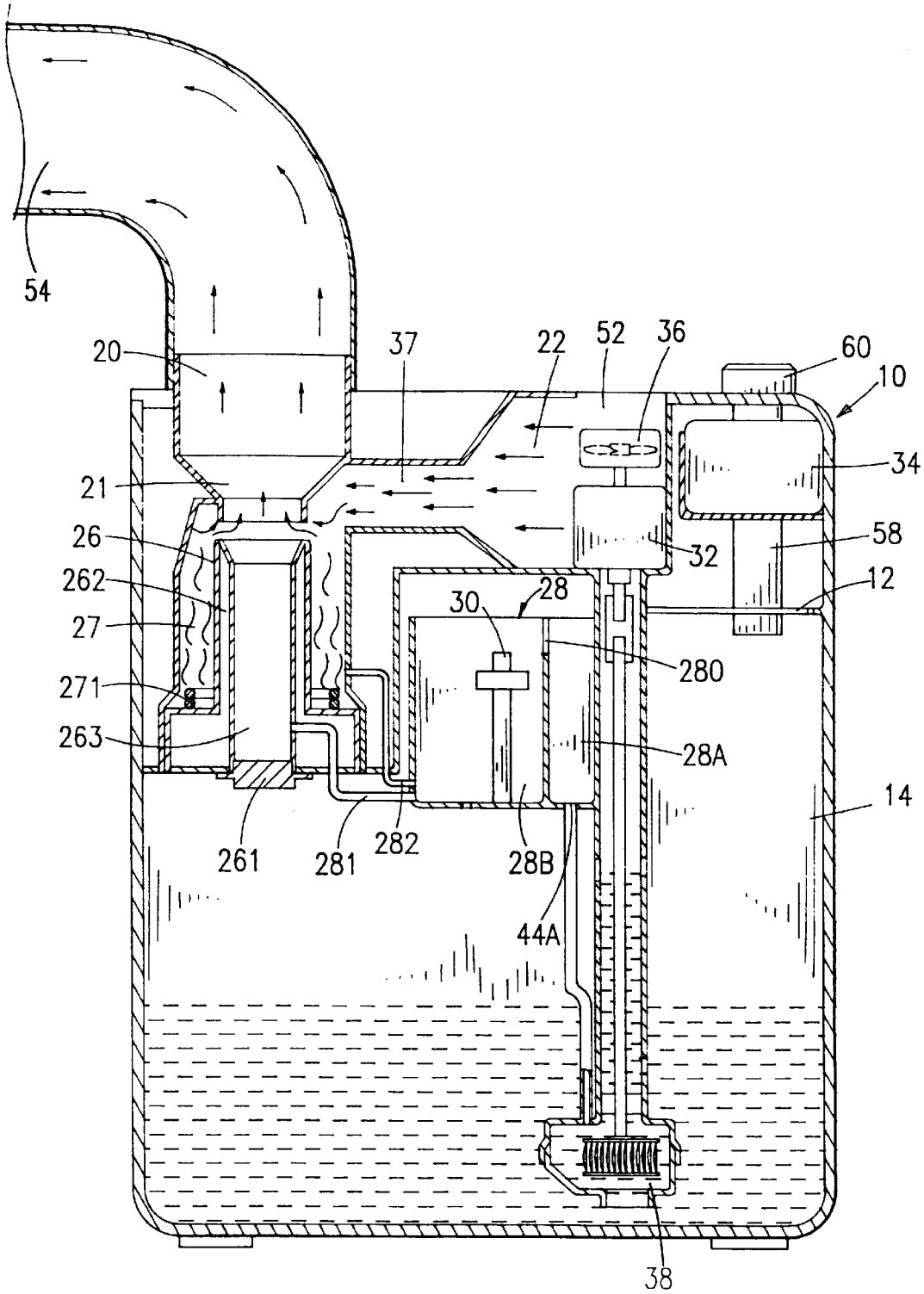
FIG. 3 is a partial view of FIG. 1 illustrating water is completely drawn from water chambers once cool and warm mist generation operations are stopped simultaneously.

Referring to FIGS. 1–5, there is shown a mist humidifier constructed in accordance with the invention comprising a body 10, a main water tank 14, a vapor discharge portion 20, a blower cavity 22, a blower 36, a motor 32, a transformer 34, a pump 38, a manual water inlet 60 wherein the vapor discharge portion 20 is divided into a plurality of independent water chambers being in fluid communication with one another as shown in FIGS. 1–2. The water chambers comprise a first water chamber 28 for storing water fed from main water tank 14 having an overflow cavity and a float ball safety valve integrally formed therein, a second water chamber 26 for vaporizing water by employing a vibration technique in order to create cool mist, and a third water chamber 27 for heating water in order to create a warm mist. In detail, the first water chamber 28 is divided into a sub chamber 28A for storing water and a buffer chamber 28B having a float ball safety valve 30 submerged therein wherein water is first pumped by pump 38 from main water tank 14 and then water flows to buffer chamber 28B through overflow orifice 280 which in turn supplies to second and third water chambers 26 and 27. A nebulizer 261 is provided in the bottom of second water chamber 26 and a heater 271 is provided in the third water chamber 27 for creating a warm mist respectively. A funnel shaped buffer passageway 21 is provided in the outlet of funnel shaped discharge opening 37 in the blower cavity 22 for creating an indirect air flow effect. Such configuration is aimed at obtaining a desired temperature in the moment when mist leaving the outlet 54. The cool air discharged from opening 37 is first buffered in the funnel shaped buffer passageway 21 and then mixed with hot vapor generated in the third water chamber 27 such that the temperature of mixed mist is increased to a desired level. Further, the funnel shaped buffer passageway 21 functions as directing water drop, generated when cool mist is impinged thereon, to the second water chamber 26 not to the third water chamber 27 having hot vapor contained therein thereby preventing hot vapor generated in third water chamber 27 from being decreased in temperature when mixed with cool mist coming from the second water chamber 26. As a result, a mist having a temperature at a constant level is discharged from humidifier when humidifier is activated. Cool and hot water chambers 26 and 27 are provided concentrically as illustrated in FIGS. 1, 2, 3, and 5. Such arrangement has the advantages such as keeping the water stored in the chambers to a minimum level, a faster hot and cold mist mixing speed is obtained because they are adjacent, and most importantly, for example, keeping temperature of cool water chamber 26 below 60° C. An insulation layer 262 is enclosed between cold water chamber 26 and hot water chamber 27 for keeping water temperature of the water chamber 26 in a desired low level as such nebulizer 261 can operate in a safe low temperature, thereby prolonging the life cycle of the electronics in nebulizer 261 as well as employing a relaively low cost nebulizer.

With respect to the float ball safety valve 30 in the buffer chamber 28B of first water chamber 28, it is designed that float ball safety valve 30 is open if water in the buffer chamber 28B has not reached a predetermined level which in turn deactivates nebulizer 261 and heater 271 for preventing from operating when there is no water in the first water chamber 28. It is also designed that the operation of the pump 38 submerged in main water tank 14 is controlled by a safety device (not shown). The float ball safety valve 30 further provided by the invention is aimed at providing an additional safety protection. In other words, this is a double safety arrangement.

Figure 4:
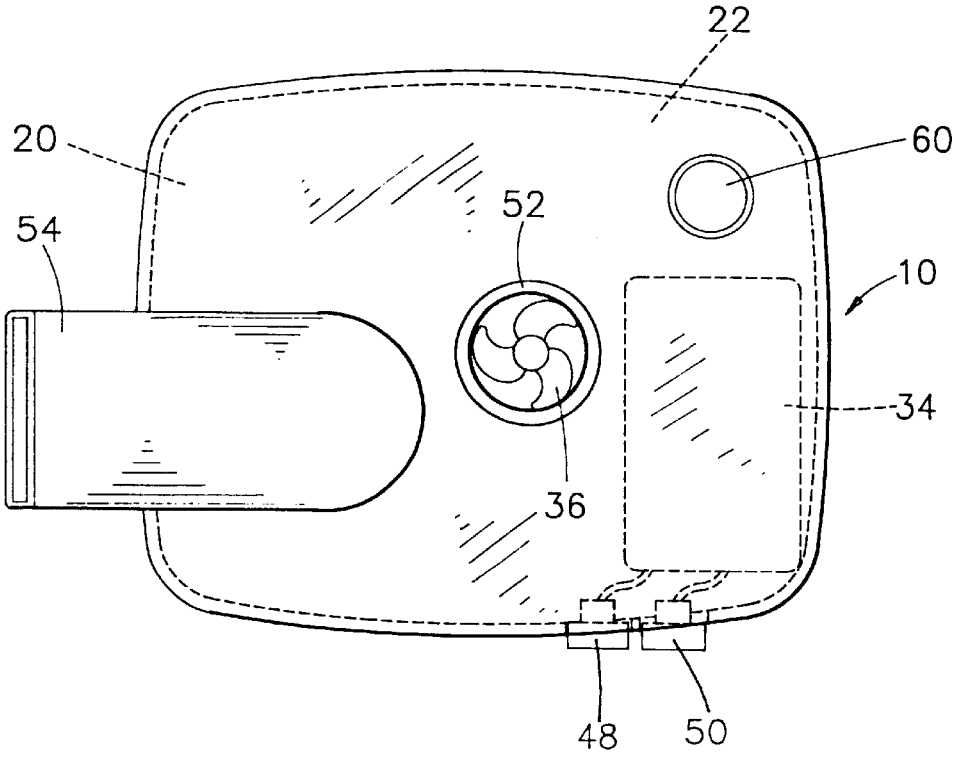
FIG. 4 is a top view of FIG. 1.
Figure 5:
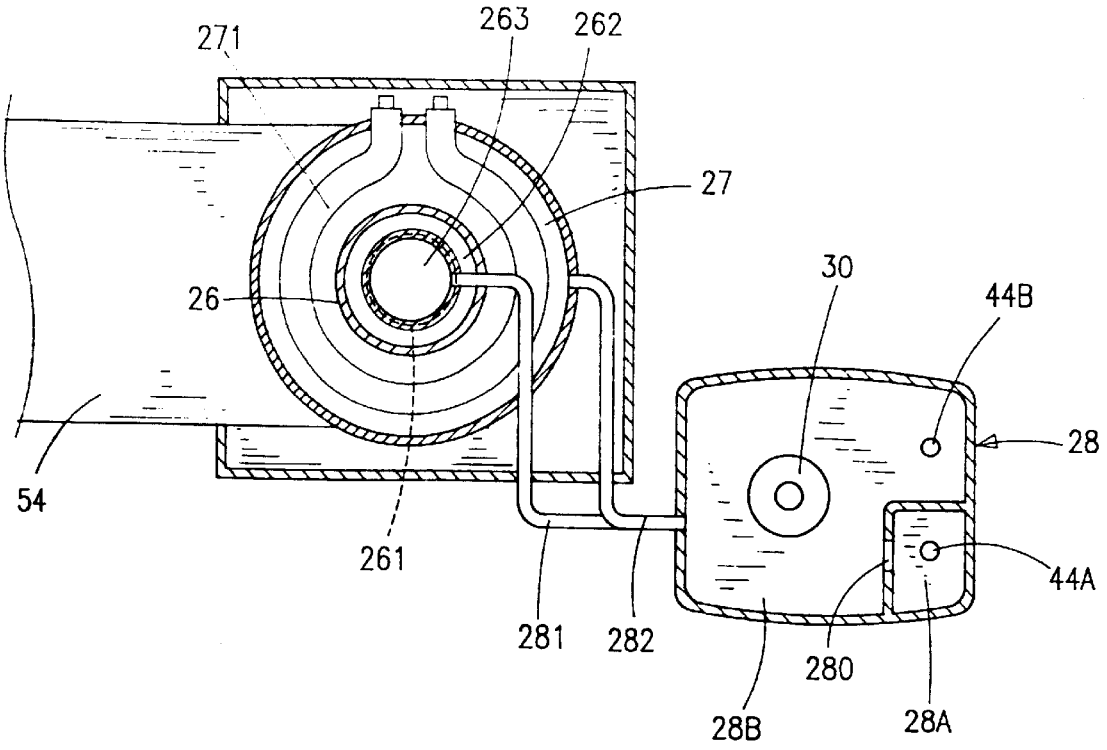
FIG. 5 is a top sectional view taken along line 5—5 of FIG. 1.

As shown in FIG. 4, a power switch 48 and a selector switch 50 are provided on the top panel of the housing of humidifier 10 being electrically connected to transformer 34 for controlling the on/off of humidifier and selecting operating voltage respectively, thereby adjusting the output power of motor 32 and nebulizer 261 and heater 271 which in turn regulates the amount of discharged mist.

In an important feature of the invention, the water supply tubes 281, 282 are provided on the bottom of the first water chamber 28 being in fluid communication with the second and third water chambers 26 and 27, respectively. In other words, a very small consumption of water due to the mist generation will cause water to automatically feed from first water chamber 28 to second and third water chambers 26 and 27 instantly. As an end, the water level of all water chambers are always kept at a constant equal level during the operation. By utilizing this, the temperature of the mist discharged from the discharging tube 54 is always kept in a constant level. It is remarkably used for beautifying woman's face.

In another important feature of the invention, the bottom of first water chamber 28 is lower than that of second and third water chambers 26 and 27. Further, an outlet 44B (FIG. 5) is provided in the bottom of buffer chamber 28B having a diameter smaller than that of the inlet 44A thus enabling water to feed to water chamber 26 and 27 in operation as shown in FIGS. 1–2. It is designed that water in all water chambers flow back to main water tank 14 when humidifier is not operated, i.e., no water retained in water chambers 26, 27, and 28. It means that the water chambers 26–28 are always kept clean when not used. Further, motor 32 will continue to operate a predetermined period of time for drying the water chambers after humidifier is stopped so as to forestall the growth of micro-organisms in the water chambers.

In still another aspect of the invention the water chamber 28 is divided into a plurality of compartments being in fluid communication with one another. As such, nebulizer 261 functions as converting water into a fine cool mist in second water chamber 26 and heater 271 functions as heating water for generating a fine hot mist instantly once activated. It is to be understood that hot mist and cool mist are insulated each other in respective chamber which has the advantage of saving more energy when changing the desired cool or hot mist mode as compared with prior art technique.

Figure 6:
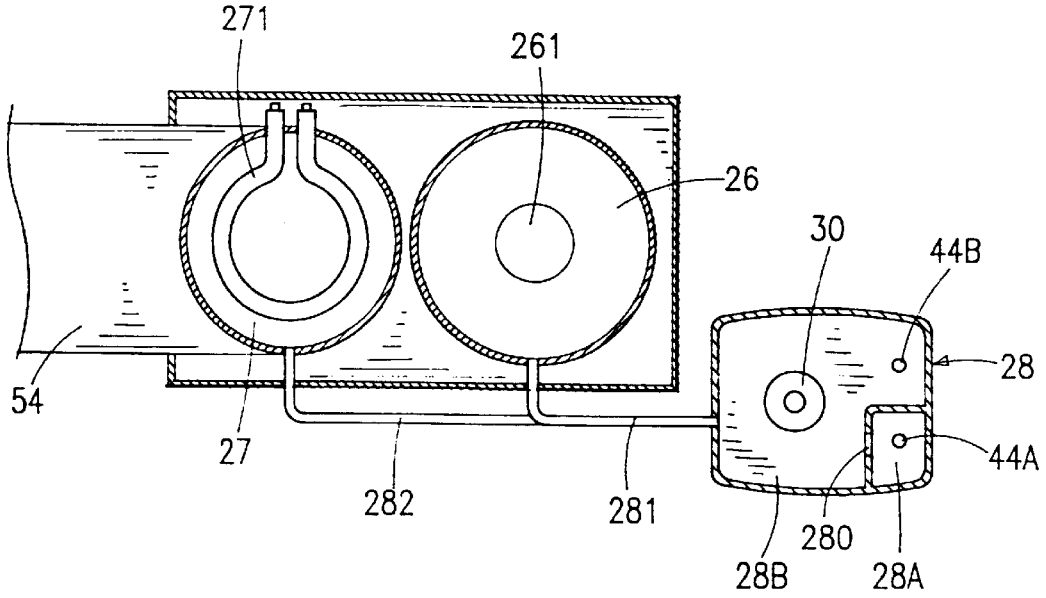
FIG. 6 is a partial top sectional view of a second embodiment of a mist humidifier of the present invention.

FIG. 6 illustrates a second embodiment of the invention having a similar configuration with that of the first embodiment except second water chamber 26 and third water chamber 27 are spaced apart a suitable distance so as to provide a better protection to the operation of nebulizer 261.

Figure 7:
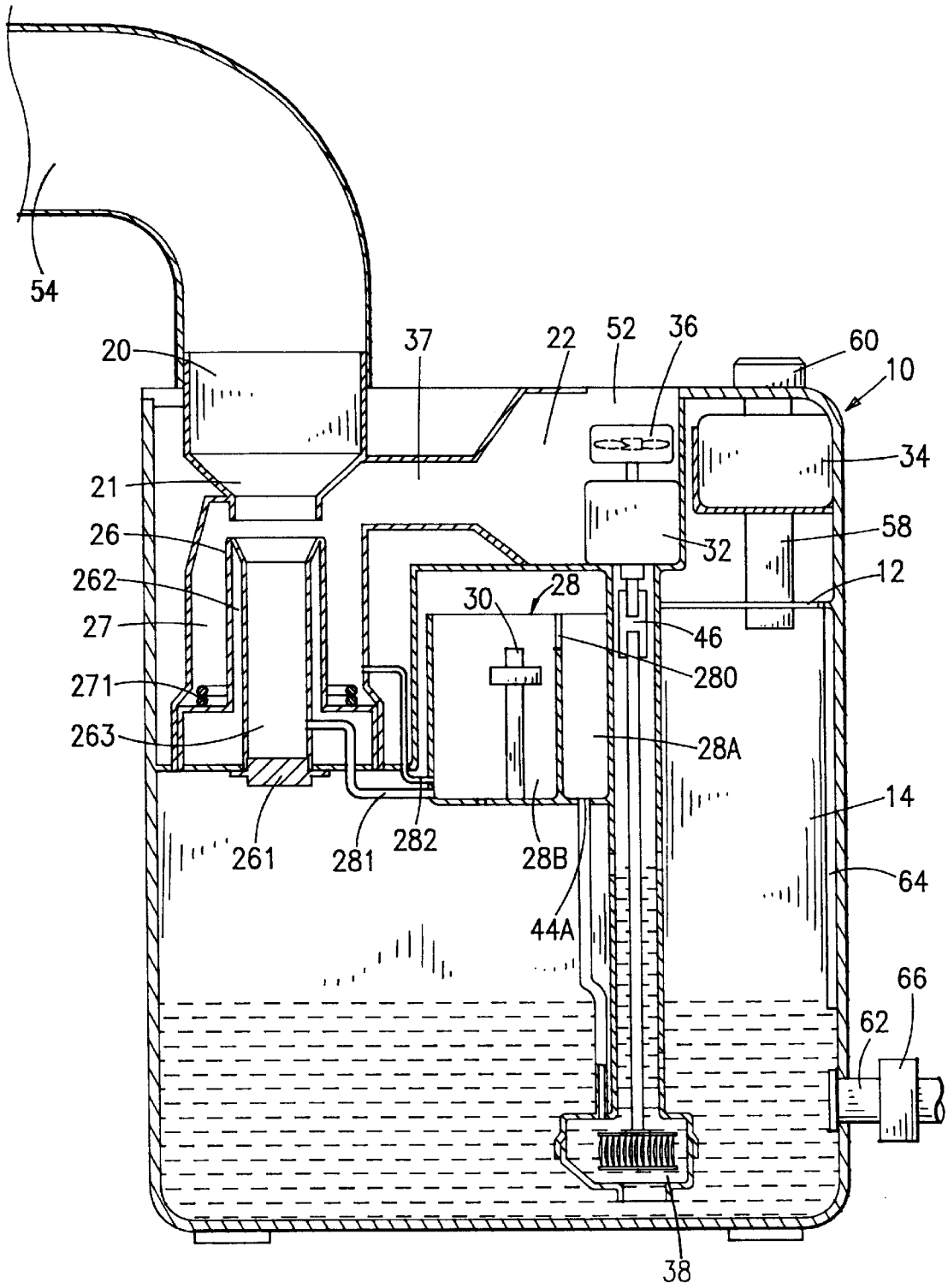
FIG. 7 is a longitudinal sectional view of a third embodiment of a mist humidifier of the present invention.

FIG. 7 illustrates a third embodiment of the invention having a similar configuration with that of the first embodiment except an automatic water supplying device is provided in addition to the manual water inlet 60. The automatic water supplying device comprises a pipe 62 for supplying water from a source (not shown) to main water tank 14 and a water level detector 64 provided in the main water tank 14. A solenoid valve 66 is provided for controlling the on/off of pipe 62. That is, a start signal is generated by the detector 64 when the water level is lowered to a predetermined minimum level. Then the solenoid valve 66 is activated to open in response to the start signal for supplying water from outside source to the main water tank 14 through pipe 62. To the contrary, a stop signal is generated by the detector 64 when the water level rises to a predetermined maximum level. Then the solenoid valve 66 is activated to close in response to the stop signal for stopping water supplying to the main water tank 14 through pipe 62.

While the invention herein disclosed has been described by means of specific embodiments, numerous modifications and variations could be made thereto by those skilled in the art without departing from the scope of the invention set forth in the claims.

What is claimed is:

1. A mist humidifier capable of discharging mist having a temperature at a constant level, comprising:

is a body for storing liquid;

a nebulizer;

a warm mist discharge outlet; and a blower for drawing ambient air into the body in order to create an air stream to discharge from an outlet of a funnel shaped discharge opening thereof;

wherein the body is divided into a lower space receiving a main water tank for storing liquid and an upper space divided into an evaporative cavity and a blower cavity; the evaporative cavity is divided into a first water chamber for storing water fed from the main water tank having a float ball safety valve, a second water chamber for receiving the nebulizer for converting water into a fine cool mist, a third water chamber for receiving a heater for heating water for generating a hot mist; and a water supply tube provided on a bottom of the first water chamber in fluid communication with the second and the third water chambers so as to keep the water chambers at a constant equal level, whereby a mist having a temperature at a constant level is discharged from the warm mist discharge outlet when the humidifier is activated.

2. The mist humidifier of claim 1, wherein water levels of the second and the third water chambers are controlled by a water level of the first water chamber.

3. The mist humidifier of claim 1, wherein water stored in the water chambers flows back to the main water tank when the humidifier is deactivated.

4. The mist humidifier of claim 1, wherein a small consumption of water during the mist generation causes water to feed from the first water chamber to second and third water chambers instantly.

5. The mist humidifier of claim 1, wherein a bottom end of the warm mist discharge outlet comprises a funnel shaped buffer passageway above the second water chamber and adjacent to the outlet of the funnel shaped discharge opening in the blower cavity for creating an indirect mist and air mixture flow prior to discharging to the warm mist discharge outlet.

6. The mist humidifier of claim 5, wherein the funnel shaped buffer passageway functions as directing water drops generated when the cool mist is impinged thereon to the second water chamber, thereby preventing the hot mist in the third water chamber from mixing with the cool mist coming from the second water chamber.

7. The mist humidifier of claim 1, wherein the first water chamber is divided into a sub water chamber having an overflow orifice and a buffer chamber having a float ball safety valve submerged therein wherein water coming from the main water tank flows to the buffer chamber through the overflow orifice which in turn flows to the second and the third water chambers.

8. The mist humidifier of claim 1, wherein the second water chamber and the third water chamber are spaced apart a predetermined distance so as to provide thermal protection to the nebulizer.

9. The mist humidifier of claim 1, wherein the second and the third water chambers are provided concentrically with the second water chamber enclosed by the third water chamber.

10. The mist humidifier of claim 1, wherein water is supplied to the main water tank continuously when the humidifier is activated.

11. The mist humidifier of claim 1, further comprising an automatic means for supplying water to the main water tank continuously when the humidifier is activated.

12. The mist humidifier of claim 11, wherein the automatic means comprises a pipe for supplying water from an external source to the main water tank, a water level detector provided in the main water tank, and a solenoid valve provided on the pipe for controlling an activation of the pipe.

* * * * *